US010240321B2

(12) United States Patent
Kenkel et al.

(10) Patent No.: US 10,240,321 B2
(45) Date of Patent: Mar. 26, 2019

(54) METHOD FOR UTILIZING SINGLE INPUT DEVICE AND BUTTON TO CONTROL MULTIPLE AUXILIARY FUNCTIONS

(71) Applicant: Deere & Company, Moline, IA (US)

(72) Inventors: Aaron Kenkel, Dubuque, IA (US); Michael Gratton, Dubuque, IA (US); Grant Henn, Dubuque, IA (US); David Myers, Dubuque, IA (US); Timothy K. Dreger, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 162 days.

(21) Appl. No.: 15/338,970

(22) Filed: Oct. 31, 2016

(65) Prior Publication Data

US 2018/0119385 A1 May 3, 2018

(51) Int. Cl.

| | |
|---|---|
| ***E02F 9/20*** | (2006.01) |
| ***E02F 3/96*** | (2006.01) |
| *E02F 3/34* | (2006.01) |
| *E02F 3/413* | (2006.01) |
| *G05G 9/047* | (2006.01) |

(52) U.S. Cl.

CPC ..... *E02F 9/2012* (2013.01); *E02F 3/962* (2013.01); *E02F 9/2004* (2013.01); *E02F 3/34* (2013.01); *E02F 3/413* (2013.01); *G05G 2009/04774* (2013.01)

(58) Field of Classification Search

CPC ..... E02F 9/2012; E02F 3/962; E02F 9/2004

See application file for complete search history.

(56) References Cited

U.S. PATENT DOCUMENTS

| | | | | |
|---|---|---|---|---|
| 4,574,651 | A * | 3/1986 | Nordstrom | B64D 31/04 200/61.85 |
| 6,354,023 | B1 * | 3/2002 | Trahan | E01H 4/02 37/219 |
| 6,571,902 | B2 * | 6/2003 | Heyne | A01B 63/10 180/321 |
| 6,636,200 | B2 | 10/2003 | Kataoka et al. | |
| 6,694,240 | B1 * | 2/2004 | Swick | E02F 9/166 701/50 |
| 7,823,685 | B2 * | 11/2010 | Blind | A01B 63/00 180/315 |
| 7,990,367 | B2 | 8/2011 | Oki et al. | |
| 8,037,680 | B2 | 10/2011 | Breuer et al. | |
| 8,160,785 | B2 * | 4/2012 | Kahle | E02F 9/2267 701/50 |
| 8,594,895 | B2 * | 11/2013 | McKee | G05B 19/409 701/29.1 |
| 2015/0145790 | A1 | 5/2015 | Kim et al. | |
| 2015/0252552 | A1 | 9/2015 | Yi et al. | |

* cited by examiner

*Primary Examiner* — Faye M Fleming

(57) ABSTRACT

An operator control system for a work vehicle having at least one work vehicle actuator and at least one removable attachment with at least one attachment actuator. The operator control system comprises an operator control interface. At least one control device is coupled to the operator control interface. The control device is configured to control at least one of the work vehicle actuator and the attachment actuator. A shift device is configured to shift the control device from controlling at least one of the work vehicle actuator and the attachment actuator to the other of the at least one of the work vehicle actuator and the attachment actuator.

20 Claims, 3 Drawing Sheets

METHOD FOR UTILIZING SINGLE INPUT DEVICE AND BUTTON TO CONTROL MULTIPLE AUXILIARY FUNCTIONS

FIELD OF THE DISCLOSURE

The present disclosure generally relates to work vehicles, and more particularly to a system and method for shifting a control device to an attachment actuator of a removable attachment.

BACKGROUND OF THE DISCLOSURE

In order to control a removable attachment, additional control devices are commonly used to control the attachment actuators.

SUMMARY OF THE DISCLOSURE

In one embodiment, an operator control system for a work vehicle is disclosed. The work vehicle having at least one work vehicle actuator and at least one removable attachment with at least one attachment actuator. The operator control system comprises an operator control interface. At least one control device is coupled to the operator control interface. The control device is configured to control at least one of the work vehicle actuator and the attachment actuator. A shift device is configured to shift the control device from controlling at least one of the work vehicle actuator and the attachment actuator to the other of the at least one of the work vehicle actuator and the attachment actuator.

In another embodiment, a work vehicle is disclosed. The work vehicle comprises at least one work vehicle actuator. At least one removable attachment with at least one attachment actuator is provided. An operator control system is provided that comprises an operator control interface. At least one control device is coupled to the operator control interface. The control device is configured to control at least one of the work vehicle actuator and the attachment actuator. A shift device is configured to shift the control device from controlling at least one of the work vehicle actuator and the attachment actuator to the other of the at least one of the work vehicle actuator and the attachment actuator.

In yet another embodiment, a method for controlling a work vehicle is disclosed. The work vehicle having at least one work vehicle actuator and at least one removable attachment with at least one attachment actuator. The method comprising grasping an operator control interface. The method also comprising manipulating at least one control device coupled to the operator control interface. The control device is configured to control at least one of the work vehicle actuator and the attachment actuator. The method comprising engaging a shift device configured to shift the control device from controlling at least one of the work vehicle actuator and the attachment actuator to the other of the at least one of the work vehicle actuator and the attachment actuator.

Other features and aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Further embodiments of the invention may include any combination of features from one or more dependent claims, and such features may be incorporated, collectively or separately, into any independent claim.

DETAILED DESCRIPTION

Figure 1:
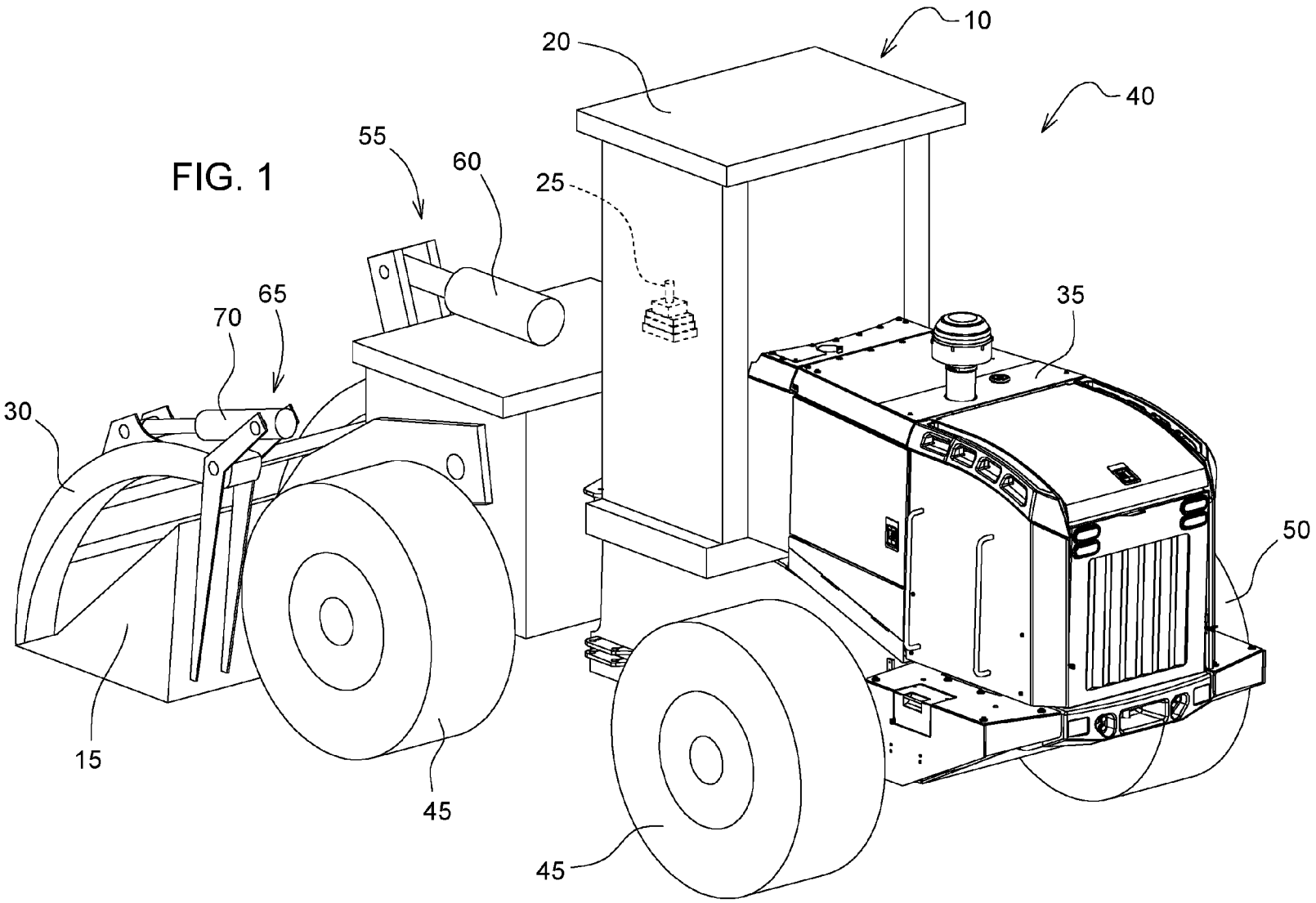
FIG. 1 is a perspective view of a wheel loader according to one embodiment.

FIG. 1 illustrates a work vehicle 10 having a bucket 15, an operator station 20 having an operator control interface 25, a removable attachment 30, and an engine 35. The work vehicle 10 may be any work vehicle to which a removable attachment 30 may be coupled, such as a crawler or an excavator, to name a few examples. The illustrated work vehicle 10 is a wheel loader 40 having a pair of left wheels 45 and a pair of right wheels 50. The work vehicle 10 may be controlled by an operator located in the operator station 20. The operator may command the work vehicle 10 to move forward, move backward, and turn. In the case of the work vehicle 10, those commands are sent to hydraulic pumps, driven by the engine 35, which direct pressurized hydraulic fluid to hydraulic motors that turn tracks or wheels. The engine 35 may be a diesel engine. Alternatively, the tracks or wheels may be turned by electric motors.

The bucket 15 is positioned at a front of the work vehicle 10 and may be attached to the work vehicle 10 in a number of different manners. In this embodiment, the bucket 15 is attached to the work vehicle 10 through a linkage which includes a series of pinned joints, structural members, and at least one work vehicle actuator 55. The illustrated work vehicle actuator 55 is a bucket hydraulic cylinder 60. This configuration allows the bucket 15 to be moved up and down relative to the ground, and rotate around a lateral axis of the work vehicle 10 (i.e., a left-right axis of the work vehicle 10). These degrees of freedom permit the bucket 15 to engage the ground at many angles. Alternative embodiments may involve buckets 15 with greater degrees of freedom, such as those found on some crawlers, and those with fewer degrees of freedom, such as "pushbeam" style blades found on some other crawlers.

The removable attachment 30 is positioned at a front of the work vehicle 10 and is coupled to the bucket 15 in the illustrated embodiment. The illustrated removable attachment 30 is a grapple. Alternatively the removable attachment 30 may be positioned at a different location on the work vehicle 10. The removable attachment 30 includes at least one attachment actuator 65 that allows the removable attachment 30 to move up and down relative to the ground. The illustrated attachment actuator 65 is an attachment hydraulic cylinder 70.

The operator may command movement of the bucket 15 from the operator station 20. In the case of the work vehicle 10, those commands are sent, including mechanically, hydraulically, and/or electrically, to a hydraulic control valve. The hydraulic control valve receives pressurized hydraulic fluid from a hydraulic pump, and selectively sends such pressurized hydraulic fluid to a system of hydraulic cylinders based on the operator's commands. The hydraulic cylinders, which in this case are double-acting, in the system are extended or retracted by the pressurized fluid and thereby actuate the bucket 15.

Figure 2:
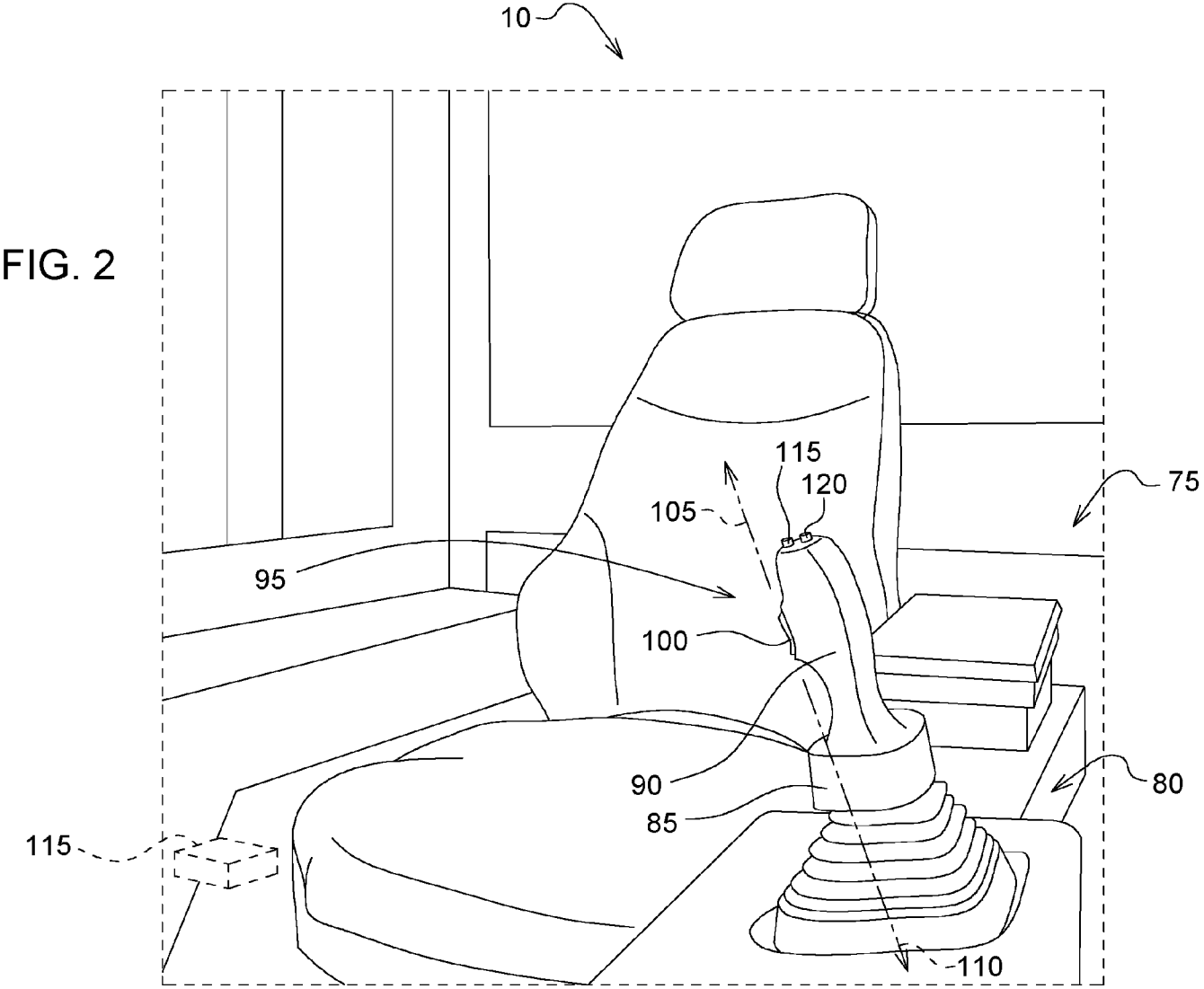
FIG. 2 is a zoomed in view of a portion of the wheel loader of FIG. 1.

With reference to FIG. 2, the work vehicle 10 has an operator control system 75. The operator control system 75 includes an operator control interface 80. The illustrated operator control interface 80 is a control lever 85 or joystick 90.

At least one control device 95 is coupled to the operator control interface 80. The control device 95 is configured to control at least one of the work vehicle actuator 55 (FIG. 1) and the attachment actuator 65 (FIG. 1). The control device 95 may be a roller switch 100 configured to be thumb actuated. The roller switch 100 may be configured to control at least one of the work vehicle actuator 55 and the attachment actuator 65 by moving the roller switch 100 in a first direction 105 and in a second direction 110, opposite of the first direction 105.

A shift device 115 is configured to shift the control device 95 from controlling at least one of the work vehicle actuator 55 and the attachment actuator 65 to the other of the at least one of the work vehicle actuator 55 and the attachment actuator 65. Alternatively, the removable attachment 30 may have a plurality of attachment actuators 65 and the shift device 115 may be configured to shift the control device 95 from controlling one of the plurality of attachment actuators 65 to another of the plurality of attachment actuators 65.

The shift device 115 may be foot actuated. Alternatively, the shift device 115 may be hand actuated. The shift device 115 may also be integral with the roller switch 100 and be configured to shift the control device 95 by depressing the roller switch 100. The shift device may be a button 120.

Figure 3:
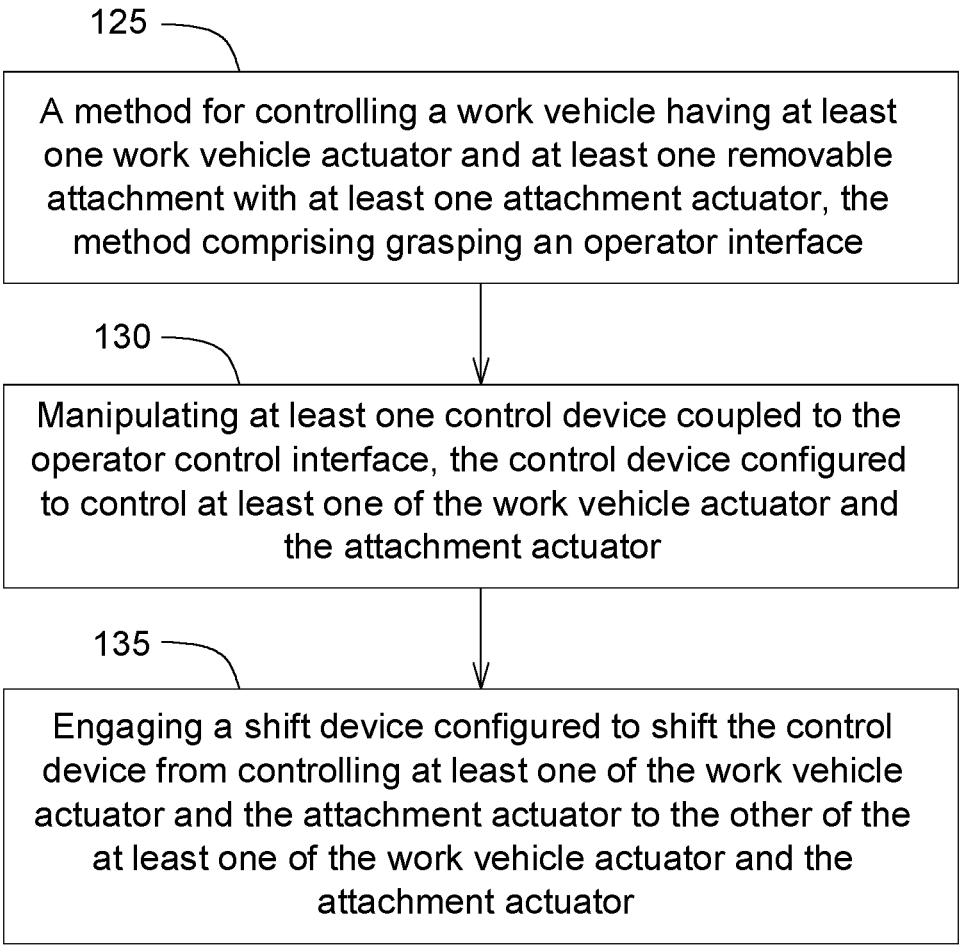
FIG. 3 is a schematic of an illustrative method for controlling a work vehicle having at least one work vehicle actuator and at least one removable attachment with at least one attachment actuator.

A method for controlling a work vehicle 10 having at least one work vehicle actuator 55 and at least one removable attachment 30 with at least one attachment actuator 65 is illustrated in FIG. 3. In Step 125, the operator control interface 80 is grasped by the operator. The operator control interface 80 may be a joystick 90. In Step 130, the control device 95 is manipulated to control at least one of the work vehicle actuator 55 and the attachment actuator 65. The control device 95 may be a roller switch 100 that is thumb actuated. The roller switch 100 may control at least one of the work vehicle actuator 55 and the attachment actuator 65 by moving the roller switch 100 in a first direction 105 and in a second direction 110, opposite of the first direction 105. In Step 135, the shift device 115 is engaged to shift the control device 95 from controlling at least one of the work vehicle actuator 55 and the attachment actuator 65 to the other of the at least one of the work vehicle actuator 55 and the attachment actuator 65. The shift device 115 may be integral with the roller switch 100 and may be configured to shift the control device 95 by depressing the roller switch 100.

Various features are set forth in the following claims.

What is claimed is:

1. An operator control system for a work vehicle having at least one work vehicle actuator and at least one removable attachment with at least one attachment actuator, the operator control system comprising:

an operator control interface;

at least one control device coupled to the operator control interface, the control device configured to control at least one of the work vehicle actuator and the attachment actuator; and a shift device configured to shift the control device from controlling at least one of the work vehicle actuator and the attachment actuator to the other of the at least one of the work vehicle actuator and the attachment actuator.

2. The operator control system of claim 1, wherein the work vehicle is a wheel loader.

3. The operator control system of claim 1, wherein the shift device is foot actuated.

4. The operator control system of claim 1, wherein the operator control interface is a control lever and the shift device is hand actuated.

5. The operator control system of claim 1, wherein the operator control interface is a joystick.

6. The operator control system of claim 1, wherein the control device is a roller switch configured to be thumb actuated.

7. The operator control system of claim 1, wherein the control device is a roller switch configured to control at least one of the work vehicle actuator and the attachment actuator by moving the roller switch in a first direction and in a second direction, opposite of the first direction.

8. The operator control system of claim 7, wherein the shift device is integral with the roller switch and is configured to shift the control device by depressing the roller switch.

9. A work vehicle comprising:

at least one work vehicle actuator;

at least one removable attachment with at least one attachment actuator; and an operator control system comprising:

an operator control interface;

at least one control device coupled to the operator control interface, the control device configured to control at least one of the work vehicle actuator and the attachment actuator; and a shift device configured to shift the control device from controlling at least one of the work vehicle actuator and the attachment actuator to the other of the at least one of the work vehicle actuator and the attachment actuator.

10. The work vehicle of claim 9, wherein the shift device is foot actuated.

11. The work vehicle of claim 9, wherein the operator control interface is a control lever and the shift device is hand actuated.

12. The work vehicle of claim 9, wherein the operator control interface is a joystick.

13. The work vehicle of claim 9, wherein the control device is a roller switch configured to be thumb actuated.

14. The work vehicle of claim 9, wherein the control device is a roller switch configured to control at least one of the work vehicle actuator and the attachment actuator by moving the roller switch in a first direction and in a second direction, opposite of the first direction.

15. The work vehicle of claim 14, wherein the shift device is integral with the roller switch and is configured to shift the control device by depressing the roller switch.

16. A method for controlling a work vehicle having at least one work vehicle actuator and at least one removable attachment with at least one attachment actuator, the method comprising:

grasping an operator control interface;

manipulating at least one control device coupled to the operator control interface, the control device configured to control at least one of the work vehicle actuator and the attachment actuator; and engaging a shift device configured to shift the control device from controlling at least one of the work vehicle actuator and the attachment actuator to the other of the at least one of the work vehicle actuator and the attachment actuator.

17. The method of claim 16, wherein the removable attachment has a plurality of attachment actuators and the shift device is configured to shift the control device from controlling one of the plurality of attachment actuators to another of the plurality of attachment actuators.

18. The method of claim 16, wherein the control device is a roller switch configured to be thumb actuated.

19. The method of claim 16, wherein the control device is a roller switch configured to control at least one of the work vehicle actuator and the attachment actuator by moving the roller switch in a first direction and in a second direction, opposite of the first direction.

20. The method of claim 19, wherein the shift device is integral with the roller switch and is configured to shift the control device by depressing the roller switch.

* * * * *